US007686423B2

(12) United States Patent
Sato et al.

(10) Patent No.: US 7,686,423 B2
(45) Date of Patent: Mar. 30, 2010

(54) LIQUID DISCHARGE HEAD AND MANUFACTURING METHOD THEREOF

(75) Inventors: Osamu Sato, Chigasaki (JP); Toshiaki Hirosawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 11/756,177

(22) Filed: May 31, 2007

(65) Prior Publication Data

US 2007/0285469 A1 Dec. 13, 2007

(30) Foreign Application Priority Data

Jun. 7, 2006 (JP) ..... 2006-158376
May 22, 2007 (JP) ..... 2007-135524

(51) Int. Cl.
*B41J 2/14* (2006.01)
*B41J 2/16* (2006.01)

(52) U.S. Cl. ..... 347/50; 347/58; 347/59

(58) Field of Classification Search ..... 347/20, 347/50, 54, 56–59, 61–65, 67
See application file for complete search history.

(56) References Cited

U.S. PATENT DOCUMENTS 6,543,880 B1 4/2003 Akhavain et al.
7,425,057 B2 * 9/2008 Harada et al. ..... 347/58
2006/0012641 A1 1/2006 Komuro

FOREIGN PATENT DOCUMENTS

JP 2002-86742 3/2002
JP 2006-27108 2/2006

* cited by examiner

*Primary Examiner*—Juanita D Stephens
(74) *Attorney, Agent, or Firm*—Fitzpatrick, Cella, Harper & Scinto

(57) ABSTRACT

A liquid discharge head comprising a liquid discharge substrate in which a first liquid supply port being a penetration port for supplying a liquid is formed and is provided with a first electrode receiving electric energy for discharging the liquid on a surface thereof on one side, a supporting member which is opposed to the first electrode and a second liquid supply port being a penetration port for supplying the liquid is formed to communicate with the first liquid supply port, the supporting member provided with a second electrode for transmitting the electric energy to the first electrode on a surface opposed to the first electrode, and a conductive first intermediate member abutting with both of the first electrode and the second electrode to electrically connect the first electrode and the second electrode, wherein an abutting surface of the first intermediate member abutting with the first electrode is flattened.

7 Claims, 11 Drawing Sheets

LIQUID DISCHARGE HEAD AND MANUFACTURING METHOD THEREOF

BACKGROUND OF THE INVENTION

1. Field of the Invention

The present invention relates to a liquid discharge head discharging a liquid and a manufacturing method thereof.

2. Description of the Related Art

As a widely spread liquid discharge head in recent years, there has been an ink-jet head. As for an ink-jet printing apparatus mounting the ink-jet head, because the price thereof has lowered in recent years, it has become a problem how to manufacture the ink-jet head at an inexpensive price. For that sake, the miniaturization of the liquid discharge substrate is especially effective. For example, because, if the liquid discharge substrate is miniaturized, the realized number of recording device substrates as the liquid discharge substrates out of a silicon wafer increases, the cost reduction of the ink-jet head, the liquid discharge head, can be attained. Because the length of the recording device substrate in the lengthwise direction thereof is tending to extend (an ink discharge port row length increase) with the recent speeding-up of image recording, it is desirable to reduce the width of the recording device substrate in order to increase the realized number of the recording device substrates in the miniaturization thereof.

In a conventional ink-jet head, the recording device substrate is fixated on a supporting member, and the electrode of an electric wiring member is joined to the electrodes formed on the surface on the side of the recording device substrate on which side the ink discharge ports are formed. The joining portion is then sealed with a resin. However, because the electrodes of the recording device substrate are provided along the width direction of the recording device substrate, many electrodes concentrate if the width of the recording device substrate is reduced, and there is the possibility of making it difficult to connect the electric wiring member to the electrodes.

The technology of providing the electrodes on both surfaces of the recording device substrate and connecting these electrodes on both surfaces electrically through internal wiring in order to cope with the problem is described in Japanese Patent Application Laid-Open No. 2006-027108.

FIGS. 10A and 10B are schematic sectional views illustrating an example of an ink-jet head of the type that provides such electrodes on the back surface side of the recording device substrate. FIG. 10A is a schematic view of the recording device substrate viewed from the side of the surface on which discharge ports are opened (discharge port opening surface), and FIG. 10B is a schematic sectional view taken along a line 10B-10B of FIG. 10A.

Penetrating electrodes 12 penetrating a liquid discharge substrate 11 and ink supply ports 13 supplying ink from the back surface side to the front surface side of the liquid discharge substrate 11 are formed in the liquid discharge substrate 11. Heating resistors 15 generating energy for discharging ink from discharge ports 14 and electrodes 16 electrically connecting the heating resistors 15 and the penetrating electrodes 12 with each other are formed on the surface of the liquid discharge substrate 11. The ink supplied from the ink supply ports 13 reaches the discharge ports 14 through liquid paths 18 formed in the inside of an orifice formation member 17. The ink is given thermal energy from heating resistors 15 provided on the way to the liquid paths 18.

In such a case of attaining the electric conduction with the outside of a substrate using the electrodes penetrating the miniaturized liquid discharge substrate and the electrodes formed on the back surface of the substrate, a supporting member supporting the liquid discharge substrate to supply electric energy as well as ink is needed. As what can be applied as such a supporting member, there exists a substrate 61 described in Japanese Patent Application Laid-Open No. 2002-086742, as illustrated in FIG. 11. The substrate 61 is formed of a plurality of layers 64 such as green sheets, and dies 60 of print heads on the surface of the substrate 61 with mounting layers 65 put between the dies 60 and the surface. In the substrate 61, ink flow paths 63 and conduction paths 69 are formed through the plurality of layers 64. I/O pads 66, which are ends of the conduction paths 69 of one side, are provided on the top surface 62 of the substrate 61. The dies 60 are electrically connected to the I/O pads 66 with lead wires 68 for wire boding.

Now, it is known that the problem that is not suggested by the Japanese Patent Application Laid-Open No. 2002-086742 mentioned above is caused when a liquid discharge head achieving conduction between the back surface of a liquid discharge substrate and the front surface of a supporting member supporting the liquid discharge substrate using penetrating electrodes is considered. That is, because the dies 60 are mounted on the flattened front surface of the mounting layers 64 and electric conduction is realized by the wire bonding connections of the lead wires 68 to the I/O pads 66 of the top surface 62 of the substrate 61, the electric connection has no problem even if the top surface 62 has a somewhat irregular form.

However, if the liquid discharge substrate is miniaturized, electric connection by wire bonding is difficult to a certain number of terminals or more. Furthermore, if a liquid discharge substrate including penetrating electrodes as illustrated in FIG. 10B is mounted on a laminated supporting member such as the substrate 61, then the flatness around the ink supply ports of the front surface of the laminated supporting member becomes a problem. In particular, the ink supply ports of the miniaturized liquid discharge substrate and the electric connection structure are in a very near positional relationship, and consequently the influence of the force operating at the time of opening the ink supply ports on the irregularities of the front surface of the laminated supporting member becomes a large problem for the electric connection portions for which certain connection is required.

SUMMARY OF THE INVENTION

It is an object of the present invention to provide a liquid discharge head capable of surely achieving the electric connection between a liquid discharge substrate provided with electrodes on the back surface thereof and a supporting member supporting the liquid discharge substrate, and capable of surely sealing electric connection portions from liquid supply portions. Furthermore, it is also an object to provide a manufacturing method of such a liquid discharge head.

It is another object of the present invention to provide a liquid discharge head including: a liquid discharge substrate in which a first liquid supply port being a penetration port for supplying a liquid is formed and which is provided with a first electrode receiving electric energy for discharging the liquid on a surface thereof on one side; a supporting member which is opposed to the first electrode and in which a second liquid supply port being a penetration port for supplying the liquid is formed so as to communicate with the first liquid supply port, the supporting member provided with a second electrode for transmitting the electric energy to the first electrode on a surface opposed to the first electrode; and a conductive first intermediate member abutting with both of the first electrode and the second electrode to electrically connect the first electrode and the second electrode, wherein an abutting surface of the first intermediate member abutting with the first electrode is flattened.

It is a further object of the present invention to provide a manufacturing method of a liquid discharge head including the steps of: preparing a liquid discharge substrate which a first liquid supply port being a penetration port for supplying a liquid is formed in and is provided with a first electrode on a surface on one side; forming a conductive first intermediate member on a top surface of a second electrode provided on a surface of a supporting member on one side, in which supporting member a second liquid supply port being a penetration port for supplying the liquid is formed; grinding the first intermediate member; and joining the liquid discharge substrate to the supporting member so that the first electrode and the second electrode are opposed to each other with the ground first intermediate member put between the first and the second electrodes, wherein the grinding step includes flattening the first intermediate member and the joining step includes joining the liquid discharge substrate so that the first liquid supply port communicates with the second liquid supply port, and that the first electrode is electrically connected with the first intermediate member.

Further features of the present invention will become apparent from the following description of exemplary embodiments with reference to the attached drawings.

DESCRIPTION OF THE EMBODIMENTS

In the following, the exemplary embodiments of the present invention are described with reference to the attached drawings.

Figure 1A:
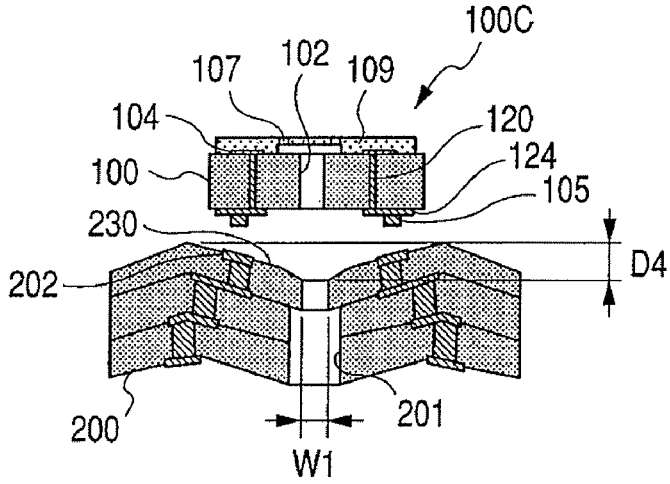
FIGS. 1A and 1B are schematic sectional views illustrating an ink-jet head of the type of providing electrodes on the opposite surface of a recording liquid discharge surface of a recording device substrate and irregular deformation of an aperture portion of an ink supply port.
Figure 1B:
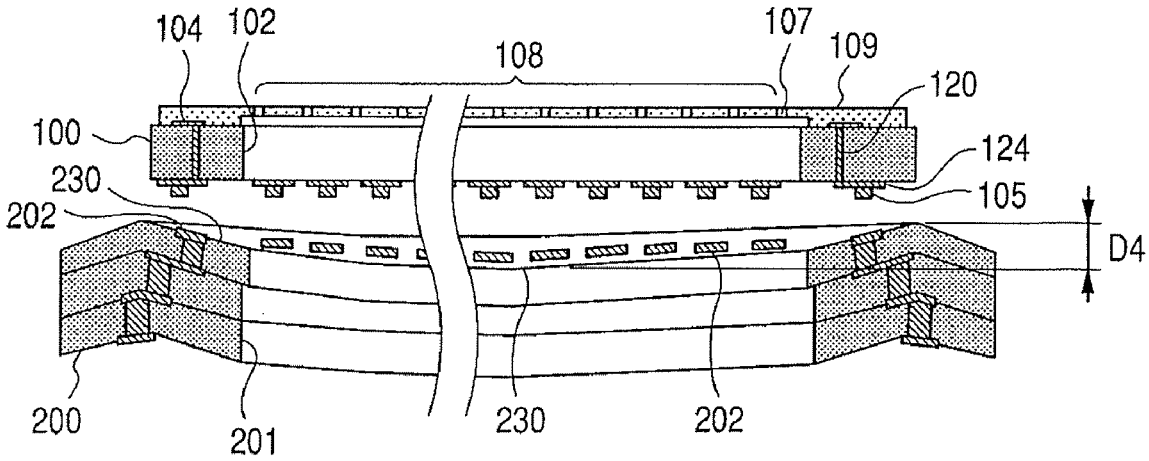

First, the state of irregular deformation of an aperture portion of an actual ink supply port in an ink-jet head of the type of providing electrodes on the back surface side of a recording device substrate is described with reference to FIGS. 1A and 1B. FIG. 1A is a sectional view illustrating the short side direction of the recording device substrate, and FIG. 1B is a sectional view illustrating the long side direction of the recording device substrate. These views illustrate a stage before joining the recording device substrate to a supporting member, and these members are joined with each other in an actual ink-jet head.

A supporting member 200 includes a second ink supply port 201, and is provided with a plurality of second electrodes 202 around the second ink supply port 201 on the surface opposed to a recording device substrate 100. In the inner part of the supporting member 200, electric paths such as vias and plane electric circuits that connect the second electrodes 202 with the back surface of the supporting member 200 are formed. The supporting member 200 is formed by laminating ceramic wiring substrates in order to efficiently form such electric paths.

The port width W1 of the second ink supply port 201 on the surface opposed to the recording device substrate 100 is about 100 μm.

A nozzle formation member 109 including discharge ports 107 discharging ink is formed on the surface of the recording device substrate 100 on one side, and the discharge ports 107 are lined in discharge port rows 108. Electrodes 104 are formed on the surface on which the nozzle formation member 109 of the recording device substrate 100 is formed, and the electrodes 104 are electrically connected with first electrodes 124 through penetrated through-holes 120. The first electrodes 124 are electrically connected with the second electrodes 202 of the supporting member 200 through bumps 105.

Now, if a large aperture is formed in a supporting member, there occurs the problem of deformation of the supporting member around the aperture. That is, if the example illustrated in FIGS. 1A and 1B is examined, irregularities occur in an ink supply port peripheral portion 230 around the ink supply port 201 on the surface of the supporting member 200 opposed to the recording device substrate 100. The maximum deformation quantity D4 of the irregularities sometimes reaches 80 μm in the case where the lengthwise direction length of the supporting member 200 is 30 mm.

Generally, if joining is performed by the thermo-compression bonding method or the ultrasonic bonding method in flip chip bonding using a bump as a buffer material, then the flatness of a joined electrode surface is required to be 10 μm or less, preferably 5 μm or less. Hereupon, the flatness means a region put between two parallel planes distant by the numerical value. Furthermore, in the case of an ink-jet head, an ink supply port is formed in the supporting member and the recording device substrate and ink is always flowing in, and accordingly it is necessary to protect (seal) the electric connection portions of the first electrodes of the recording device substrate and the second electrodes of the supporting substrate from the ink passing through the ink supply ports. As a matter of fact, because the ink supply ports are located near the electric connection portions, the necessity of sealing is high.

However, as illustrated in FIGS. 1A and 1B, if the ink supply port peripheral portion 230 deforms by a large value of the degree of the maximum deformation quantity D4 of 80 μm, then certain sealing is difficult. Moreover, the ink supply port 201 and the discharge ports 107 should be kept not to be blocked by the entering of a sealing compound into the ink supply port 201 having the port width W1 of almost the same size of 100 μm as that of the maximum deformation quantity D4.

First Exemplary Embodiment

Figure 2A:
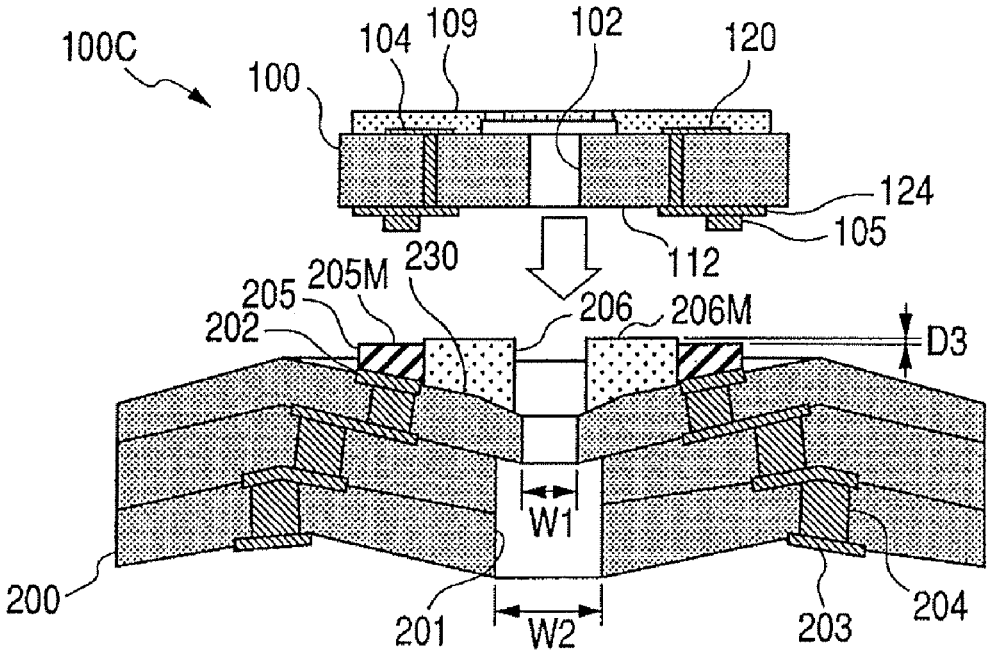
FIGS. 2A and 2B are sectional views of the principal part of a head unit to be used for an ink-jet head of a first exemplary embodiment of the present invention.
Figure 2B:
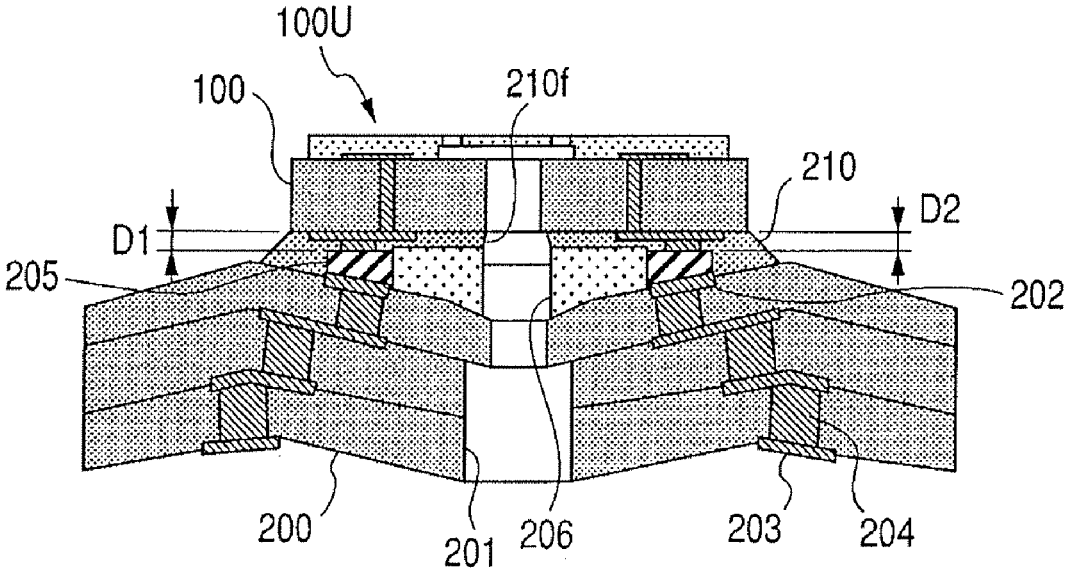

FIGS. 2A and 2B are the sectional views illustrating the principal part of a head unit to be used for an ink-jet head being an exemplary embodiment of the liquid discharge head of the present invention. FIG. 2A is the sectional view of the principal part illustrating the state at the time of joining a head chip to a supporting member, and FIG. 2B is the sectional view of the principal part illustrating the state of the completion of the head unit.

Figure 3A:
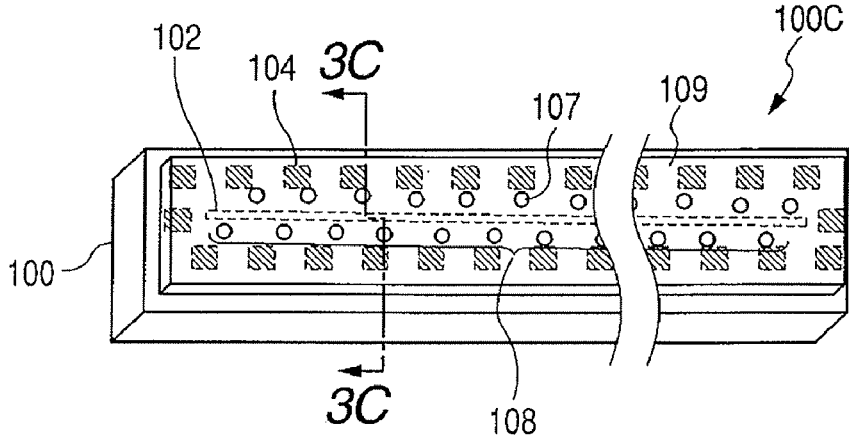
FIGS. 3A, 3B and 3C are schematic perspective views of a head chip illustrated in FIGS. 2A and 2B.
Figure 3B:
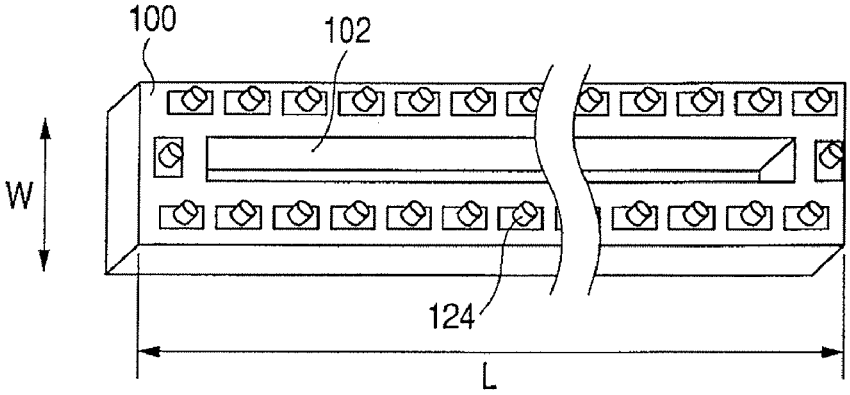
Figure 3C:
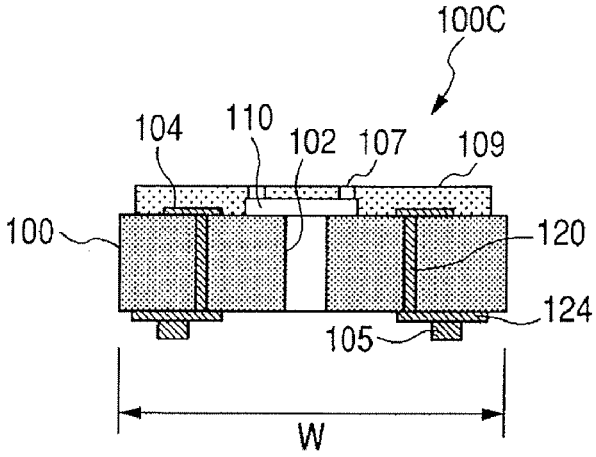

FIGS. 3A, 3B and 3C are schematic perspective views of the head chip. FIG. 3A is a perspective view viewed from the recording liquid discharge surface side; FIG. 3B is a perspective view viewed from the back surface side of a discharge port opening surface; and FIG. 3C is a sectional view taken along the line 3C-3C in FIG. 3A.

Figure 4A:
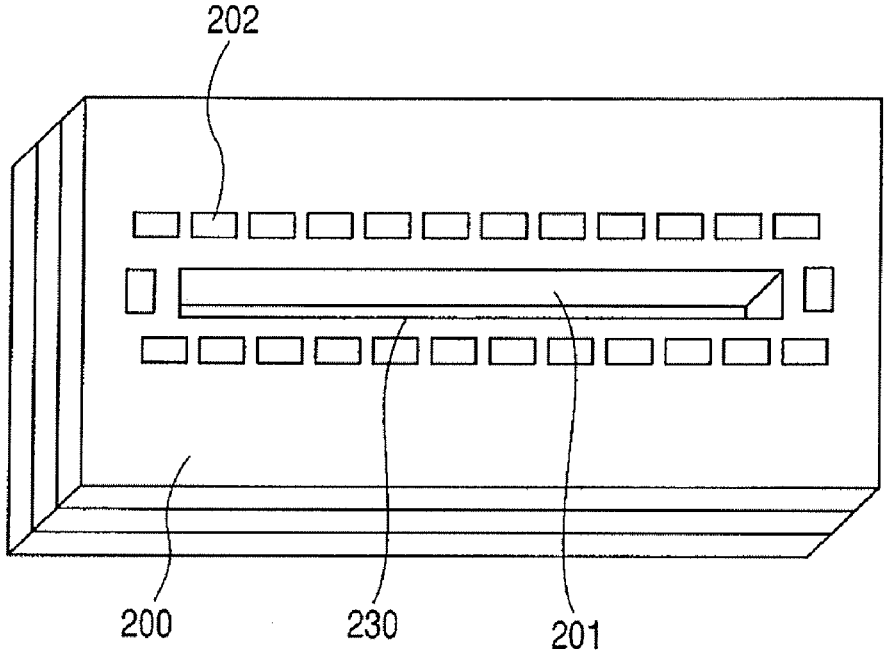
FIGS. 4A and 4B are schematic perspective views of a supporting member illustrated in FIGS. 2A and 2B.
Figure 4B:
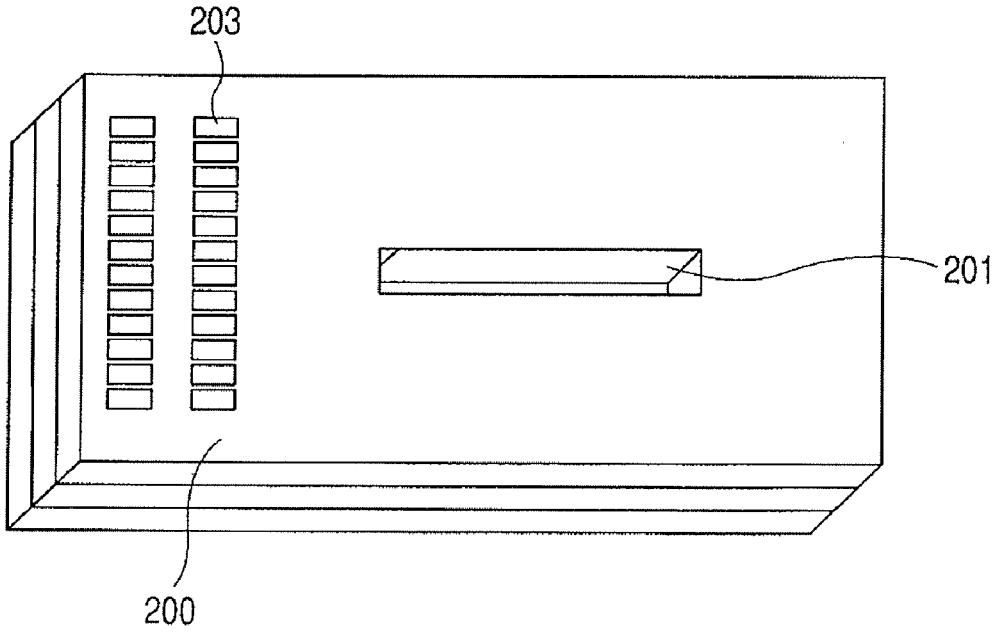

FIGS. 4A and 4B are schematic perspective views of the supporting member. FIG. 4A is a perspective view viewed from the surface opposed to the recording device substrate, and FIG. 4B is a perspective view viewed from the back surface side thereof.

The recording device substrate 100 as a liquid discharge substrate is provided with the nozzle formation member 109, in which the discharge ports 107 for discharging recording liquid or ink are opened, as illustrated in FIGS. 3A, 3B and 3C. A plurality of discharge ports 107 are aligned in rows for forming the discharge port rows 108. On the back surface side of the discharge port rows 108, a first ink supply port 102 as a first liquid supply port being a penetration port for supplying the recording liquid or the ink is opened in almost the same length as those of the discharge port rows 108. The recording liquid or the ink enters a bubbling chamber 110 from the first ink supply port 102, and bubbles by the thermal energy produced by electrothermal conversion elements (not illustrated; also called heating resistors) provided to be opposed to the discharge ports 107 to be discharged from the discharge ports 107. In the recording device substrate 100, the electrodes 104 for transmitting electric signals (electric energy) to the electrothermal conversion elements as discharge energy generation units are formed. The electrodes 104 are connected to the electrothermal conversion elements.

The penetrated through-holes 120 formed by a laser or etching are formed in the recording device substrate 100. In the penetrated through-holes 120, penetration wiring electrically connecting the electrodes 104 on the front surface of the recording device substrate 100 with the first electrodes 124 being the back surface electrodes is formed. Each of the first electrodes 124 has a thickness of about 1 μm, and receives the electric energy for discharging the ink from the second electrodes 202, which will be described later. The working cost of the penetrated through-holes 120 depends on the thickness of the recording device substrate 100. In the present exemplary embodiment, the back surface side of the recording device substrate 100 is ground in the state of not being provided with the nozzle formation member 109, and the thickness of the recording device substrate 100 is thinned from 0.625 mm to 0.2 mm.

Gold bumps 105 each having a height of 20 μm as a buffer material for a warp of the recording device substrate 100 are provided on the first electrodes 124. Incidentally, the warp of the recording device substrate 100 reaches several tens μm owing to a cure shrinkage stress of an epoxy resin when the epoxy resin is used as the nozzle formation member 109. However, the warp of the recording device substrate 100 is within a range of about 10 μm at the time of joining or after joining.

The supporting member 200 is formed by the lamination of ceramic wiring substrates, and the second ink supply port 201 as the second liquid supply port being a penetration port for supplying the ink is formed so as to communicate with the first ink supply port 102. The second ink supply port 201 is formed so that the port width W1 of the ceramic layer on the recording device substrate side and the port width W2 of the other ceramic layers may meet the relation W2>W1 in order not to produce stagnation in the flow of the ink at the time of its flowing from the lower part of FIG. 2A to the upper part of the drawing. The port width W1 is about 100 μm.

The second electrodes 202 transmitting electric energy to the first electrodes 124 are formed on the surface opposed to the first electrodes 124. Exterior electrodes 203 are formed on the back surface of the surface of the supporting member 200 on which the second electrodes 202 are formed. The exterior electrodes 203 receive electric energy from the exterior of the ink-jet head. Conductors 204 such as vias and plane wiring are provided in the inner part of the supporting member 200 to connect the second electrodes 202 to the exterior electrodes 203.

Electrically-conductive first intermediate members 205 are formed between the bumps 105 provided on the first electrodes 124 and the second electrodes 202. The first intermediate members 205 abut against both of the bumps 105 provided on the first electrodes 124 and the second electrodes 202 to electrically connect the first electrodes 124 with the second electrodes 202. The abutting surfaces 205M of the first intermediate members 205 against the bumps 105 formed on the first electrodes 124 are flattened. It is desirable that the abutting surfaces 205M are formed to be almost parallel to a surface 112, on which the first electrodes 124 of the recording device substrate 100 are formed. The abutting surfaces 205M of the first intermediate members 205 are flattened to the flatness of 10 μm or less.

Non-conductive second intermediate members 206 are formed along the peripheries of the first ink supply port 102 and the second ink supply port 201 in the state of adhering closely to the first intermediate members 205 and the supporting member 200. The opposed surfaces 206M of the second intermediate members 206 to the recording device substrate 100 are flattened. It is also desirable that the opposed surfaces 206M are almost parallel to the surface 112, on which the first electrodes 124 of the recording device substrate 100 are formed.

Non-conductive sealing members 210 are provided in order to seal the spaces between the second intermediate members 206 and the recording device substrate 100 and the spaces between the first intermediate members 205 and the recording device substrate 100. The sealing members 210 also seal the space between the supporting member 200 and the recording device substrate 100 on the outside of the first intermediate members 205.

Because the abutting surfaces 205M of the first intermediate members 205 are flattened, more certain joining can be performed at the time of joining the first electrodes 124 and the second electrodes 202 with the gold bumps 105 put between them. Furthermore, the opposed surfaces 206M of the second intermediate members 206 are also flattened. The spaces between the second intermediate members 206 and the recording device substrate 100 and the spaces between the first intermediate members 205 and the recording device substrate 100 can be precisely formed to have uniform intervals. The sealing members 210 are thereby more certainly filled up in these spaces, and consequently more reliable sealing is enabled. When the abutting surfaces 205M are formed to be almost parallel to the surface 112, on which the first electrodes 124 of the recording device substrate 100 are formed, the opposed surfaces 206M are formed to be almost parallel to the surface 112 of the recording device substrate 100, their effects are more heightened.

Next, a manufacturing method of the ink-jet head described above is described, laying stress on the joining method of the supporting member and the recording device substrate.

Figure 5A:
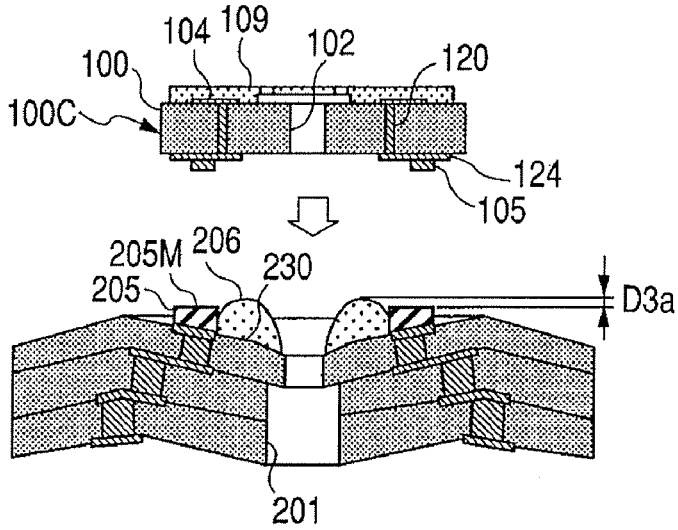
FIGS. 5A, 5B and 5C are sectional views of the principal part illustrating a flattening process of a supporting member.
Figure 5B:
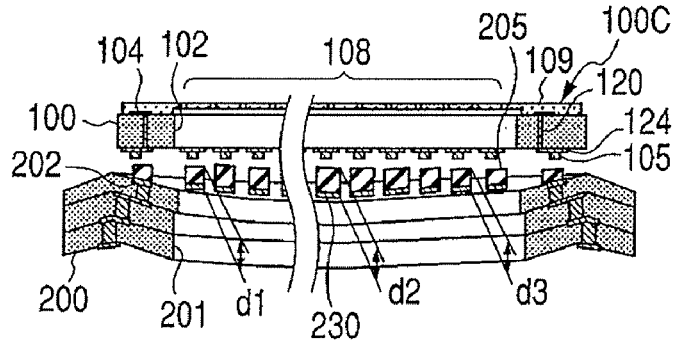
Figure 5C:
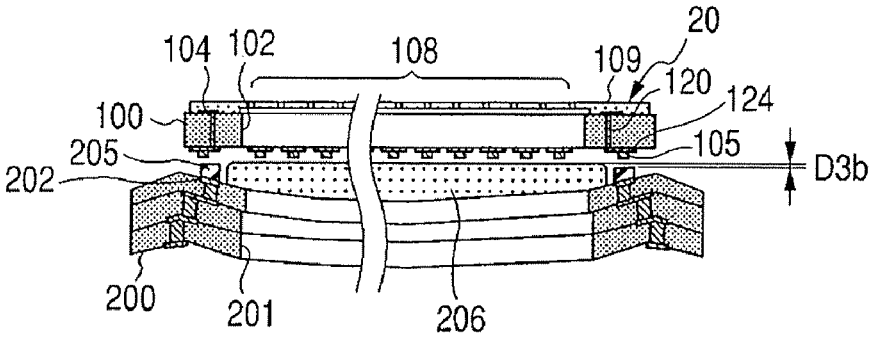

FIGS. 5A, 5B and 5C are the sectional views illustrating the principal part of a flattening process of the supporting member. FIG. 5A is the sectional view of the principal part of the recording device substrate and the supporting member that are cut in the short side direction of the recording device substrate; FIG. 5B is the sectional view of the principal part in the direction perpendicular to that of FIG. 5A; and FIG. 5C is the sectional view of the principal part illustrating the state in which the second intermediate members are applied.

First, the first intermediate members 205 are formed on the top surface of the second electrodes 202 of the supporting member 200, which the second ink supply port 201 is formed in and is provided with the second electrodes 202 on one surface thereof. To put it concretely, as illustrated in FIG. 5A, the first intermediate members 205 are formed to be about 80 μm in thicknesses by the screen printing of, for example, a silver paste or a soldering paste on the second electrodes 202 of the supporting member 200 made of ceramic lamination wiring substrates. The use of a metal form may be better than the use of a mesh form for the impasto of paste. Because the impasto up to 80 μm cannot be performed at one time, the paste is provisionally cured, and then applied again to be cured.

Next, the second intermediate members 206 made of, for example, an epoxy series resin, an adhesive, a sealing compound, or an imide series adhesive are, applied on the ink supply port peripheral portions 230 around the second ink supply port 201 in the state of adhering closely to the first intermediate members 205 and the supporting member 200. In order to certainly seal the first electrodes 124 and the second electrodes 202 with the sealing members 210, which will be described later, the second intermediate members 206 are desirably formed along the whole periphery of the second ink supply port 201. Because the first intermediate members 205 and the second intermediate members 206 are needed to be applied in a certain degree of thickness, the ones having the thixotropy index of 1.4 at an ordinary temperature and the viscosity of 60 Pa·s are selected in the present exemplary embodiment. The second intermediate members 206 may be applied by the screen printing, or may be applied by a screw type adhesive application apparatus.

Next, as illustrated in FIG. 2A, both of the first intermediate members 205 and the second intermediate members 206 are simultaneously ground. Generally, if joining is performed by, for example, the thermo-compression bonding method or the ultrasonic bonding method in the flip chip bonding using bumps as a buffer material, then the flatness of an electrode surface is needed to be 10 μm or less, preferably 5 μm or less. Accordingly, at least the first intermediate members 205 are desirably flattened to have the flatness of 10 μm or less.

If the first intermediate members 205 and the second intermediate members 206 are simultaneously ground, then the first intermediate members 205 and the second intermediate members 206 can be not always worked to have the same surface owing to the difference of hardness. In particular, if the second intermediate members 206 have elasticity, then the second intermediate members 206 sometimes jut onto the side of the recording device substrate 100 by the degree of several μm rather than the first intermediate members 205. However, it is more suitable that the second intermediate members 206 jut more rather than the first intermediate members 205 in order to prevent the first ink supply port 102 and the discharge ports 107 near both ends of the discharge port rows 108 from being blocked by the sealing compound 210 at the time of performing under-filling with the sealing compound 210. It goes without saying that the distance D3 of the jutting quantity must not exceed the heights, 20 μm, of the gold bumps 105 being the buffer materials at the time of joining the recording device substrate 100 with the supporting member 200.

Next, the supporting member 200 is washed, and a head chip 100C is aligned to oppose the first electrodes 124 to the second electrodes 202. In this state, the gold bumps 105 provided on the first electrodes 124 of the recording device substrate 100 and the first intermediate members 205 of the supporting member 200 are joined together by an ultrasonic wave. The first ink supply port 102 thereby communicates with the second ink supply port 201, and the first electrodes 124 are electrically connected to the second electrodes 202 through the first intermediate members 205.

After that, the non-conductive sealing members 210 are subjected to under-filling into the space between the second intermediate members 206 and the recording device substrate 100 and the space between the first intermediate members 205 and the recording device substrate 100. If the sealing compound 210 is applied to the periphery of the head chip 100C, then the sealing compound 210 permeates the spaces mentioned above by capillary phenomenon. After that, if the sealing member is heated to be cured, then a head unit 100U illustrated in FIG. 2B is completed.

The distance D1 between the joint surface of the recording device substrate 100 and the first intermediate members 205 of the supporting member 200 is 17 μm when the heights of the bumps 105 are supposed to be 20 μm, and when the film thickness of the first electrode 124 is supposed to be 2 μm, and when the crushing quantity (arbitrarily settable to each product) at the time of flip chip mounting is supposed to be 5 μm. Moreover, as described above, the second intermediate members 206 are worked to jut more rather than the first intermediate members 205 by about several μm. If the maximum amount of the distance D3 is supposed to be, for example, 5 μm, then the distance D2 between the joint surface of the recording device substrate 100 and the second intermediate members 206 becomes about 12-14 μm, which is less than the distance D1 by the distance D3. The distances D1 and D2 can be controlled to be almost constant.

Constant and stable force owing to the capillary phenomenon consequently works on the gaps at the time of the under-filling of the sealing compound 210, and the sealing compound 210 is certainly permeating into the gaps. Furthermore, stable fillets 210*f* are formed on the edge portions of the recording device substrate 100 and the second intermediate members 206 on the first ink supply port 102 side. The stable formation of the ink supply ports 102 and 201 can be performed without being blocked by the sealing compound 210.

Although the sealing compound 210 as an under-filling agent having low thixotropy and low viscosity is suitable, it is needed to select the one having the optimum viscosity in order to form the stable fillets 210*f* and to secure the first ink supply port 102. In the present exemplary embodiment, the epoxy that is heated to be cured at 110° C. is used, but, because the lowering of viscosity occurs at the time of heating, the one having the thixotropy index of 1.0 and the viscosity of 44 Pa·s at an ordinary temperature is selected.

As described above, according to the described first exemplary embodiment, the electric connection portions between the first electrodes 124 and the second electrodes 202 can be certainly formed, and the sealing performing the certain protection from the recording liquid or the ink that passes through the ink supply port 201 can be performed. Furthermore, the problem of the blocking of the first ink supply port 102 and the discharge ports 107 near both ends of the discharge port rows 108 becomes difficult to occur.

Second Exemplary Embodiment

In the following, a second exemplary embodiment of the present invention is described with reference to FIGS. 5A, 5B and 5C. In the present exemplary embodiment, the first intermediate members 205 and the second intermediate members 206 are individually flattened (ground). That is, first, as illustrated in FIG. 5B, only the first intermediate members 205 such as the silver paste are formed similarly to the first exemplary embodiment, and are flattened to form the abutting surfaces 205M. Next, as illustrated in FIG. 5A, the second intermediate members 206 made of an epoxy resin, an adhesive, a sealing compound or an imide series adhesive are applied to the ink supply port peripheral portion 230 around the ink supply port 201. The second intermediate members 206 are thereby formed along the periphery of the second ink supply port 201, adhering closely to the first intermediate members 205 and the supporting member 200. The second intermediate members 206 are applied so as to jut more rather than the abutting surfaces 205M of the first intermediate members 205.

FIG. 5A illustrates the top portions of the second intermediate members 206 and the distances D3*a* from the abutting surfaces 205M after the curing of the second intermediate members 206. After the curing of the second intermediate members 206, the heights of the abutting surfaces 205M of the first intermediate members 205 are measured, and the second intermediate members 206 are ground so that the distance D3*b* becomes about the distance D3 (for example 5 μm) of the first exemplary embodiment as illustrated in FIG. 5C.

According to the present exemplary embodiment, because the possibility of the prevention of the working of the silver paste owing to the blocking of the teeth of a grinder for grinding by a resin decreases in comparison with the case of simultaneously grinding both of the first intermediate members 205 and the second intermediate members 206, flattening working without the blocking of the teeth of a grinder can be performed. The process after that is the same as that of the first exemplary embodiment.

Third Exemplary Embodiment

The present exemplary embodiment is provided with a helical screw around the major axis, and uses a screw type adhesive application apparatus capable of finely controlling the feed quantity of an adhesive by the forward and reverse rotations of the screw. By finely controlling the application quantity like this, the application thicknesses of the second intermediate members 206 are controlled. The flattening working of the second intermediate members 206 in the second exemplary embodiment is thereby made to be unnecessary. With reference to FIG. 5B, first, the step quantities d1, d2 and d3 between the abutting surfaces 205M of the first intermediate members 205 and the ink supply port peripheral portion 230 are measured with a laser displacement meter or the like. Next, the second intermediate members 206 are applied so that the steps between the second intermediate members 206 and the abutting surfaces 205M of the first intermediate members 205 become 5 μm similarly to the exemplary embodiments described above. The application quantity is changed according to the step quantities d1, d2 and d3 by adjusting the rotation speed of the screw and the moving speed of the application apparatus at this time. After that, the second intermediate members 206 are heated to be cured. The grinding working of the second intermediate members 206 is thereby made to be unnecessary, and the teeth of the grinder for grinding are not blocked by resin. Consequently, an economic ink-jet head can be provided. Incidentally, a known method is used as the method of applying an adhesive while measuring the steps with a laser displacement meter or the like.

Incidentally, even if the steps between the second intermediate members 206 and the abutting surfaces 205M of the first intermediate members 205 are made to be further smaller, the gaps between the recording device substrate 100 and the first intermediate members 205 of the supporting member 200 become narrower. Consequently, stable permeation force owing to the capillary phenomenon can be obtained at the time of under-filling. As a result, the moving speed of a robot of the adhesive application apparatus can be further sped up. Hence, more economic ink-jet head can be provided.

Fourth Exemplary Embodiment

Although it may be known from the description of the third exemplary embodiment, the application quantity of the sealing member can be also controlled by the adhesive application apparatus. Accordingly, in the present exemplary embodiment, in place of the under-filling of the sealing compound 210 after the joining of the head chip 100C to the supporting member 200, the sealing compound 210*b* is applied after flattening working, and then the joining of the head chip 100C to the supporting member 200 is performed.

Figure 6A:
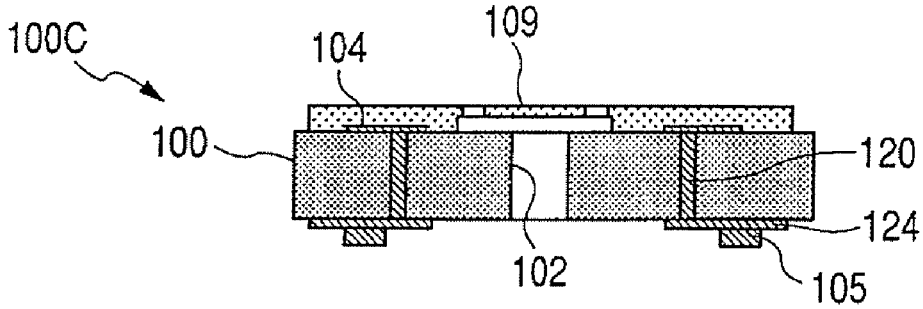
FIGS. 6A and 6B are schematic sectional views illustrating a manufacturing method of an ink-jet head according to a fourth exemplary embodiment.
Figure 6B:
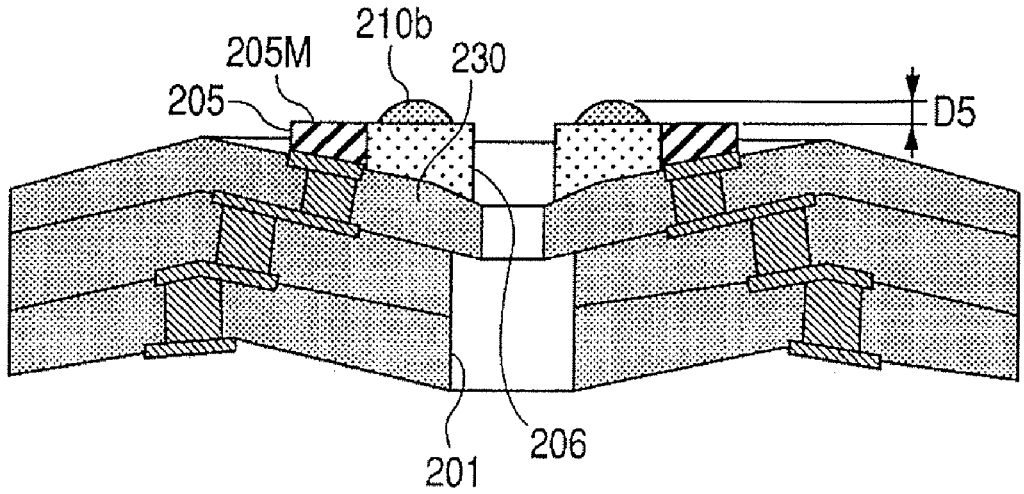

FIGS. 6A and 6B are schematic sectional views illustrating a manufacturing method of an ink-jet head according to a fourth exemplary embodiment. FIG. 6A is the sectional view of the principal parts of a recording device substrate that are cut in the short side direction of a recording device substrate, and FIG. 6B is the sectional view of the principal part of a supporting member.

In each exemplary embodiment described above, the sealing compound as the under-filling agent having low thixotropy and low viscosity is selected. However, in the present exemplary embodiment, the same material as those of the second intermediate members 206 (thixotropy index: 1.4, viscosity: 60 Pa·s) is used as the sealing compound 210*b*. However, if the sealing compound is the one having high thixotropy and high viscosity, the sealing compound to be used in the present exemplary embodiment is not limited to that sealing compound. In the present exemplary embodiment, similarly to the first and the second exemplary embodiments, the sealing compound 210*b* is applied to be a fixed thickness D5 on the top surfaces of the second intermediate members 206 with the adhesive application apparatus as illustrated in FIGS. 6A and 6B after the flattening processing of the second intermediate members 206. After that, if the recording device substrate 100 is bonded to the supporting member 200 by impressing a pressure, the sealing members 210*b* deform to seal the spaces between the first intermediate members 205 and the recording device substrate 100 and between the second intermediate members 206 and the recording device substrate 100.

According to the present exemplary embodiment, the quality of sealing can be managed in the state before the joining of the head chip 100C to the supporting member 200. The present exemplary embodiment is advantageous on the improvement of quality.

The present exemplary embodiment can be combined with the third exemplary embodiment. That is, first, the step quantities d1, d2 and d3 between the abutting surfaces 205M of the first intermediate members 205 and the ink supply port peripheral portion 230 are measured with the laser displacement meter or the like. Next, the rotation speed of the screw and the moving speed of the application apparatus are adjusted so as to obtain the sealing thickness distance D2 (see FIGS. 2A and 2B), and the application quantity is changed according to the step quantities from the ink supply port peripheral portion 230 to apply the sealing compound 210*b*. After the joining of the head chip 100C to the supporting member 200, the sealing compound 210*b* is then heated and cured. Because the present exemplary embodiment can simultaneously perform the flattening and the sealing process of the second intermediate members 206, an economic ink-jet head can be provided.

Fifth Exemplary Embodiment

Next, a fifth exemplary embodiment of the present invention is described with reference to FIGS. 7A, 7B, 8A, 8B, 8C, 8D, 8E and 9. In recent years, it has been normal to use a plurality of recording device substrates as a color ink-jet head, and the present exemplary embodiment aims at such an ink-jet head provided with a plurality of recording device substrates.

Figure 7A:
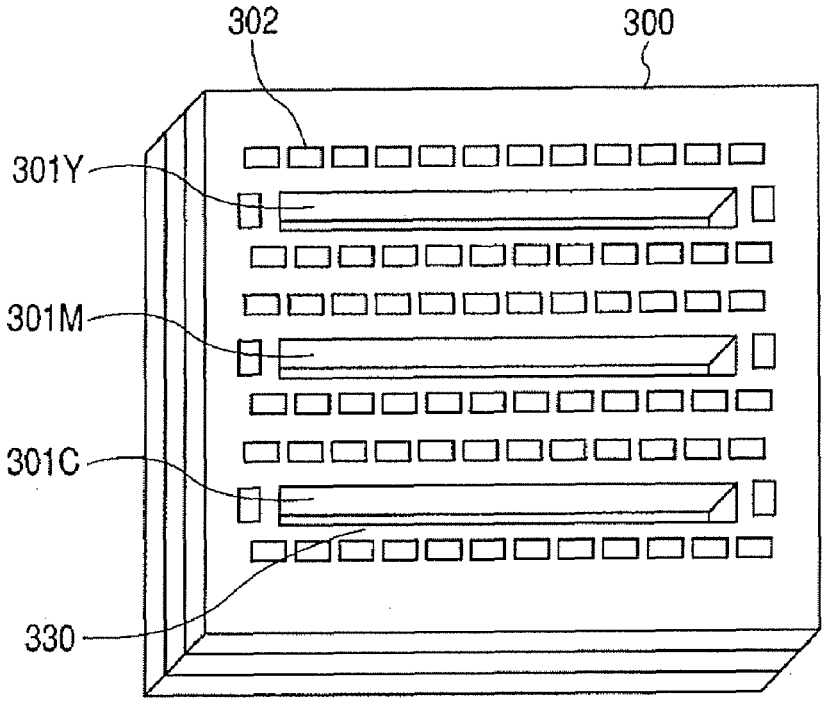
FIGS. 7A and 7B are schematic perspective views illustrating a supporting member to be used for a color ink-jet head.
Figure 7B:
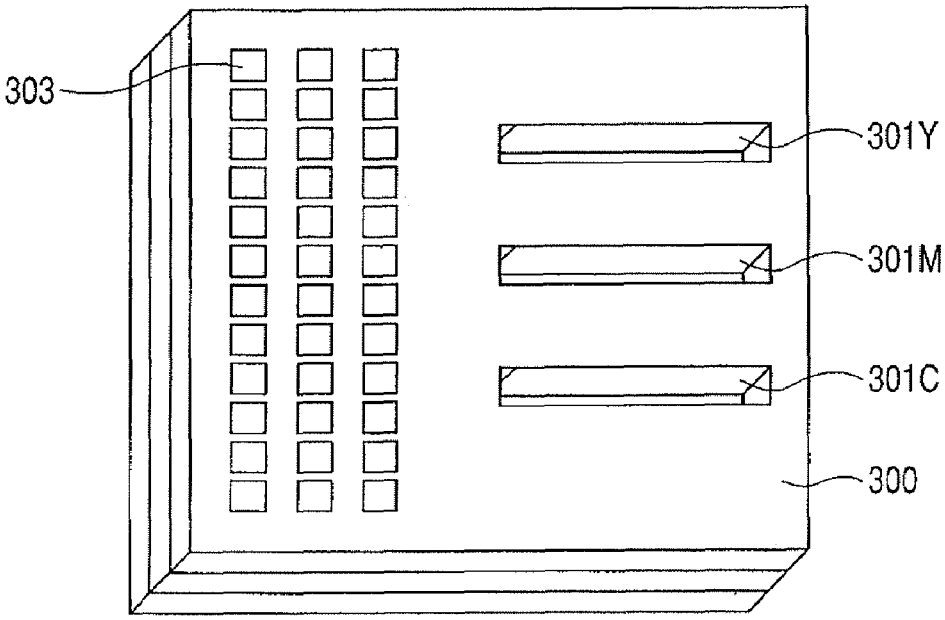

FIGS. 7A and 7B are schematic perspective views illustrating a supporting member to be used for a color ink-jet head made of ceramic lamination wiring substrates. FIG. 7A is a perspective view of the front surface side to which the head chip 100C is joined, and FIG. 7B is a perspective view of the back surface side.

A plurality of ink supply ports 301Y, 301M and 301C is formed by color in a supporting member 300 made of ceramic lamination wiring substrates, and a plurality of second electrodes 302 are provided around the ink supply ports 301Y, 301M and 301C. External electrodes 303 electrically connected with the second electrodes 302 are provided on the back surface of the supporting member 300. Incidentally, in the present exemplary embodiment, the letters Y, M and C attached to reference marks denote yellow, magenta and cyan, respectively.

FIGS. 8A, 8B, 8C, 8D and 8E are the sectional views illustrating the principal part of the ink-jet head flattening process illustrated in FIGS. 7A and 7B.

Figure 8A:
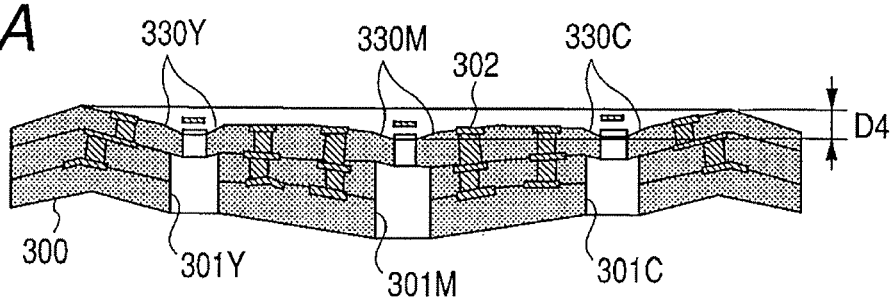
FIGS. 8A, 8B, 8C, 8D and 8E are sectional views of the principal part of the flattening process of the ink-jet head illustrated in FIGS. 7A and 7B.

First, as illustrated in FIG. 8A, the supporting member 300 on which the second electrodes 302 and ink supply ports 301Y, 301M and 301C are formed is prepared. The maximum deformation quantity D4 at the ink supply port peripheral portions 330Y, 330M and 330C of the supporting member 300 differs at each of the ink supply ports.

Figure 8B:
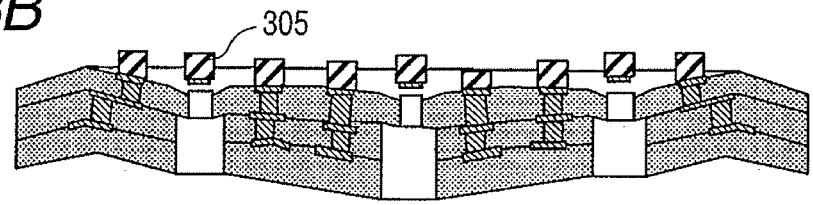
Figure 8C:
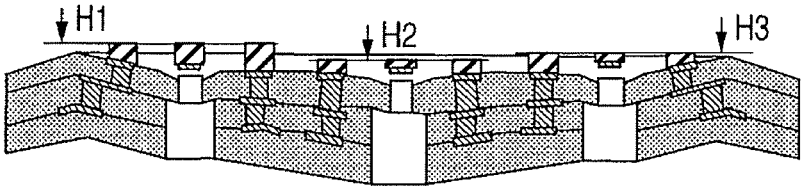
Figure 8D:
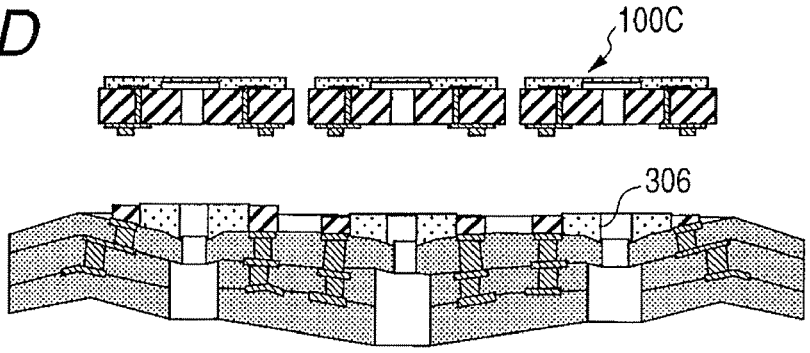
Figure 8E:
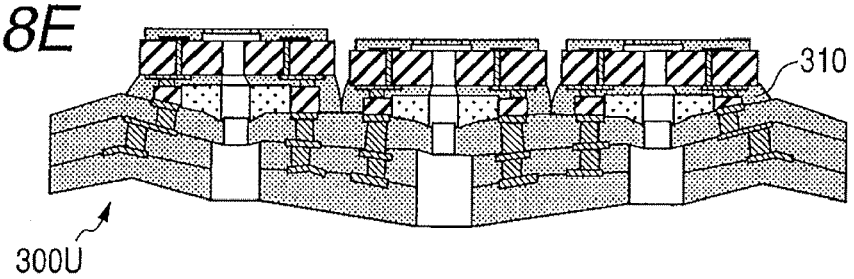
Figure 9:
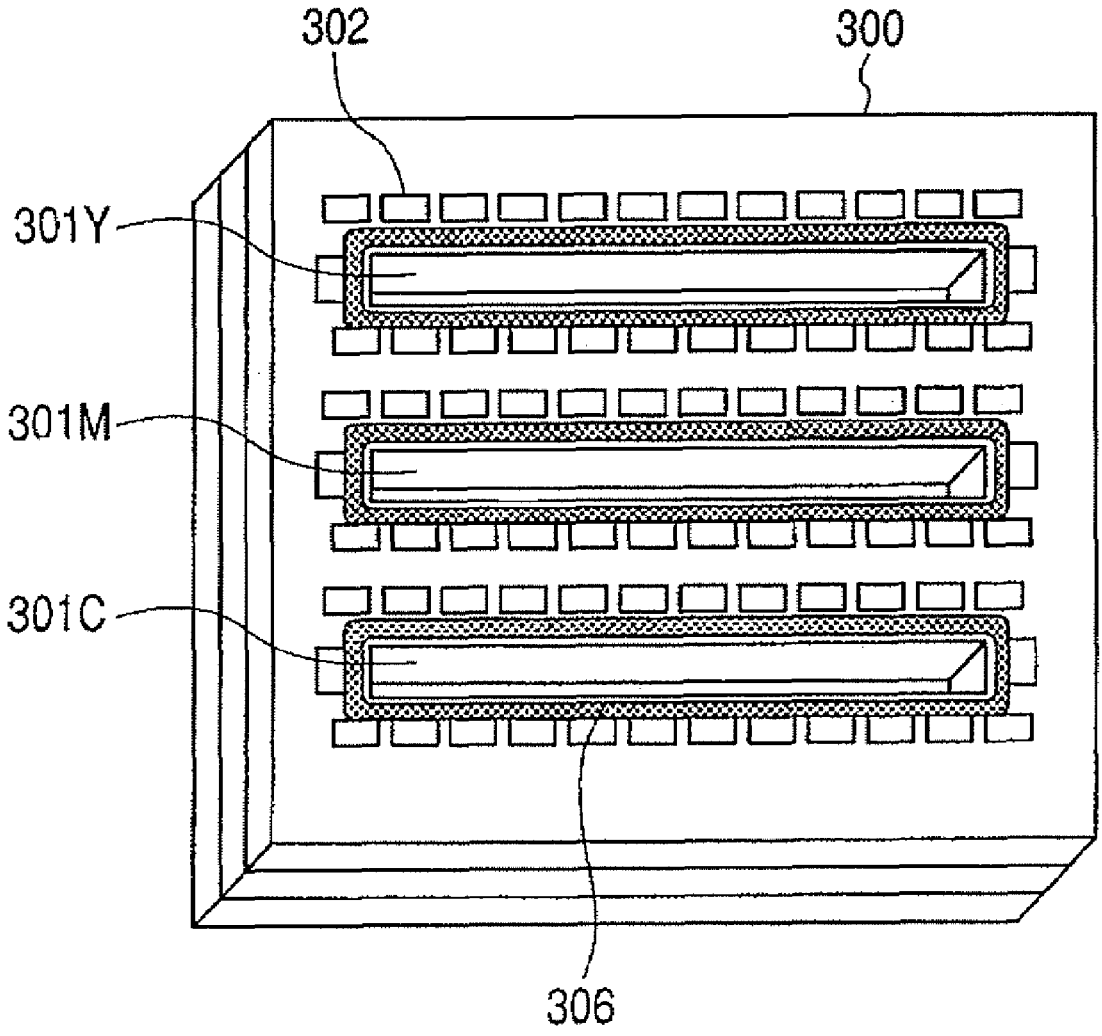
FIG. 9 is a perspective view illustrating a part of the flattening process of the ink-jet head illustrated in FIGS. 8A, 8B, 8C, 8D and 8E.
Figure 10A:
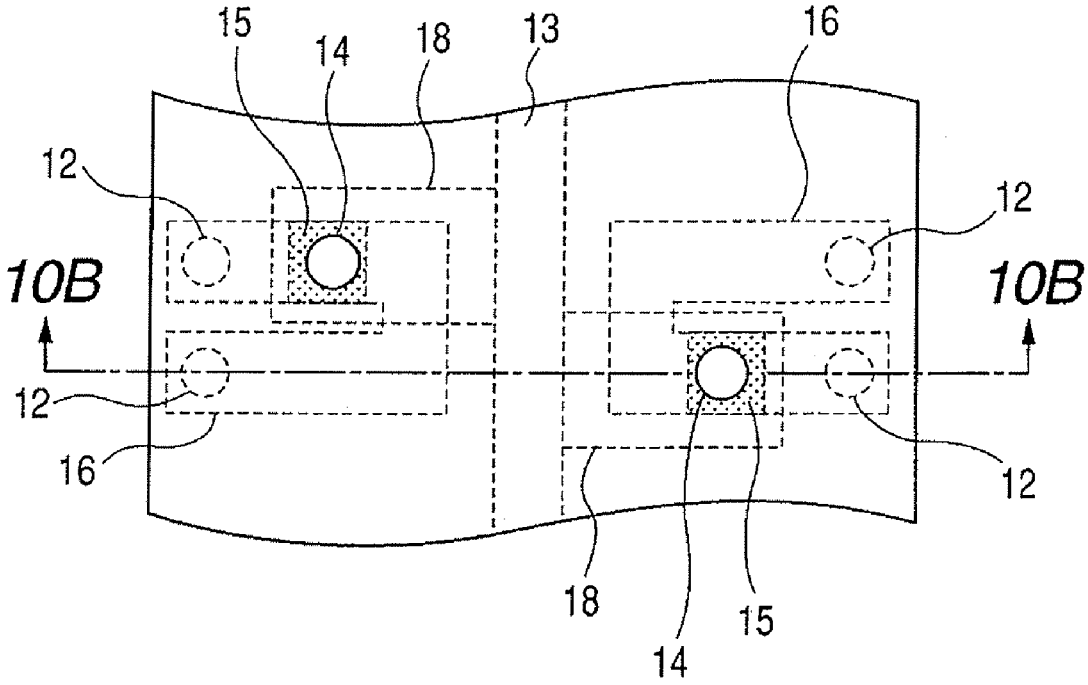
FIGS. 10A and 10B are schematic sectional views illustrating an example of an ink-jet head of the type of providing electrodes on the opposite surface of the recording liquid discharge surface of a recording device substrate.
Figure 10B:
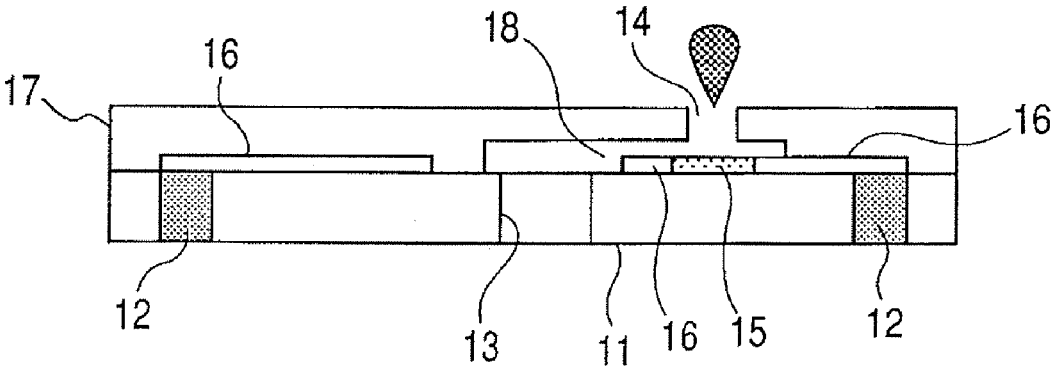
Figure 11:
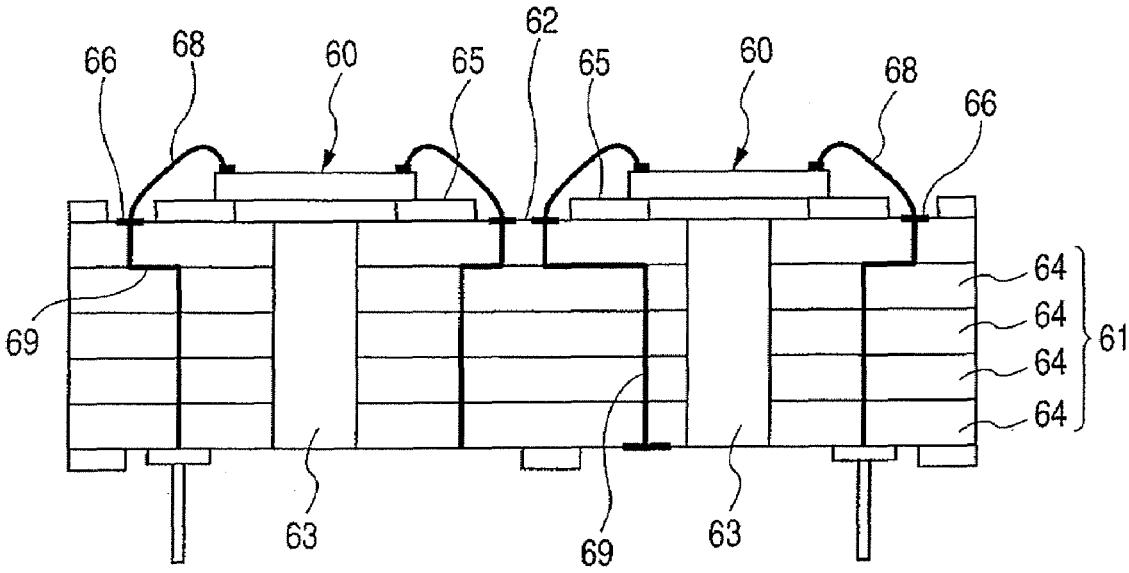
FIG. 11 is a schematic sectional view of a print head including a laminated supporting member.

Next, as illustrated in FIG. 8B, first intermediate members 305, which are made of conductive materials, are applied to the supporting member 300. Next, as illustrated in FIG. 8C, the first intermediate members 305 are flattened. Next, as illustrated in FIG. 8D, second intermediate members 306, which are made of non-conductive materials, are applied and flattened. The state is also illustrated in the perspective view of FIG. 9. After that, as illustrated in FIG. 8E, a plurality of head chips 100C are joined, and sealing is performed with sealing members 310. Then, a head unit 300U is completed.

In the present exemplary embodiment, the first and the second intermediate members are formed up to the different heights at each corresponding recording device substrate. Japanese Patent Application Laid-Open No. 2002-086742 mentioned above describes that it is better to flatten the whole surface in the case of using a plurality of ink-jet heads. However, in the present exemplary embodiment, if the first intermediate members 305 (e.g. a silver paste) are flattened all at one time, then the thicknesses of the first intermediate members 305 after working differ at parts, and there is the possibility that characteristics change at each color or at each head chip 100C. Accordingly, in the present exemplary embodiment, as shown in FIG. 8B, the fact that the first intermediate members 305 are applied to be a uniform thickness is considered, and individually flattening working is configured to be performed so that the working quantity becomes the minimum at the part where each head chip 100C is mounted to be the heights H1-H3 in FIG. 8C. Incidentally, because it is difficult to use the means for working a wide surface all at one time by grinding or lapping, certain connection in each head chip 100C or further at each individual electrode or bump is performed by performing working with a small cutter such as a tool or the like. Moreover, it is desirable to work so that the parallelism of the whole becomes the same even if working is individually performed in order to align the discharge directions of ink from the head chip 100C.

According to the present exemplary embodiment, because intermediate members having suitable thicknesses according to the irregularities of the front surfaces of the supporting member 200 and the supporting member 300 owing to the working of each of them are used at each of the ink supply ports, the sealing of individual ink supply ports, and the electric connections and sealing of the electric connection portions (electrodes, bumps) can be performed. Consequently, an economic ink-jet printing apparatus having aligned characteristics of each head chip and high reliability can be provided.

Each ink-jet head of the exemplary embodiments mentioned above uses a supporting member made of the ceramic lamination wiring substrates. However, the materials of the lamination wiring substrates are not limited to the ceramic, but, for example, a resin-made supporting member can be applied to the present invention as long as the supporting member can form front surface wiring and penetrate ink supply ports.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-158376, filed Jun. 7, 2006, and 2007-135524, filed May 22, 2007, which are hereby incorporated by reference herein in their entirety.

What is claimed is:

1. A liquid discharge head comprising:

a liquid discharge substrate in which a first liquid supply port being a penetration port for supplying a liquid is formed and which is provided with a first electrode receiving electric energy for discharging the liquid on a surface thereof on one side;

a supporting member which is opposed to the first electrode and in which a second liquid supply port being a penetration port for supplying the liquid is formed so as to communicate with the first liquid supply port, the supporting member provided with a second electrode for transmitting the electric energy to the first electrode on a surface opposed to the first electrode; and a conductive first intermediate member abutting with both of the first electrode and the second electrode to electrically connect the first electrode and the second electrode, wherein an abutting surface of the first intermediate member abutting with the first electrode is flattened.

2. The liquid discharge head according to claim 1, wherein the abutting surface of the first intermediate member is flattened to a flatness of 10 μm or less.

3. The liquid discharge head according to claim 1, wherein the liquid discharge head further includes:

a non-conductive second intermediate member formed along peripheries of the first liquid supply port and the second liquid supply port, adhering closely to the first intermediate member and the supporting member; and a non-conductive sealing member formed so as to seal at least a space between the second intermediate member and the liquid discharge substrate.

4. The liquid discharge head according to claim 3, wherein an opposed surface of the second intermediate member to the liquid discharge substrate is flattened.

5. The liquid discharge head according to claim 4, wherein the opposed surface of the second intermediate member juts to a side of the liquid discharge substrate more than the abutting surface of the first intermediate member.

6. The liquid discharge head according to claim 3, wherein a plurality of liquid discharge substrates are provided, and the first intermediate member and the second intermediate member are formed up to a different height position to each of the corresponding liquid discharge substrates.

7. The liquid discharge head according to claim 1, further comprising:

an external electrode provided on a back surface of a surface on which the second electrode is formed to receive the electric energy from an outside of the liquid discharge head; and a conductor provided in an inner part of the supporting member to electrically connect the second electrode to an outer electrode.

* * * * *